US005456631A

United States Patent [19]

Janes et al.

[11] Patent Number: 5,456,631

[45] Date of Patent: Oct. 10, 1995

[54] HOOD STYLE EXHAUST SYSTEM CONSTRUCTION

[75] Inventors: Michael R. Janes; Klaus W. Lachmann, both of Crystal Lake, Ill.

[73] Assignee: Eisenmann Corporation, Crystal Lake, Ill.

[21] Appl. No.: 289,634

[22] Filed: Aug. 12, 1994

[51] Int. Cl.[6] ..... B08B 15/02

[52] U.S. Cl. ..... 454/65; 454/67

[58] Field of Search ..... 454/63, 64, 65, 454/67, 49

[56] References Cited

U.S. PATENT DOCUMENTS

| | | | |
|---|---|---|---|
| 928,158 | 7/1909 | Smethurst | 454/64 |
| 2,761,373 | 9/1956 | Owen . | |
| 4,286,776 | 9/1981 | Laimer | 454/65 X |
| 4,714,010 | 12/1987 | Smart | 454/64 |

FOREIGN PATENT DOCUMENTS

| | | | |
|---|---|---|---|
| 797809 | 1/1981 | U.S.S.R. | 454/67 |

*Primary Examiner*—Harold Joyce
*Attorney, Agent, or Firm*—Gerald S. Geren

[57] ABSTRACT

An exhaust gas system for receiving and treating exhaust gases from different processing tanks including a hood supported by a moveable crane to direct exhaust gases from a selected tank to a selected exhaust duct. Exhaust gas then flows to a treatment site. A connector system is provided to connect the duct to the hood/crane combination. A flow rate sensor and air admission damper system is provided in association with the duct to sense the flow rate in the duct, to permit the addition of ambient air to the duct, by opening the damper, and thus assure a substantially constant flow rate to the treatment site.

14 Claims, 3 Drawing Sheets

HOOD STYLE EXHAUST SYSTEM CONSTRUCTION

BACKGROUND OF THE INVENTION

This invention relates to industrial exhaust systems, and more particularly to an exhaust system for efficiently and effectively removing exhaust gases from a plurality of processing tanks.

In industrial applications there are systems which require the treatment of parts in a plurality of processing tanks. Such treatment may include submersion of a part in a first treatment tank, removal of the part and submersion in a wash tank, removal and submersion in a second treatment tank, etc. Such tanks, could contain an alkali, a rinse and an acid. Sometimes these parts are large enough to require the use of an overhead crane for the movement and transportation of the parts.

Each tank is usually closed so that when it is opened there is an initial release or surge of exhaust gas perhaps at 7,000 cubic feet per minute (CFM). Then during operation the tank gives off exhaust gas but at a secondary or a slower rate, perhaps at 1,000 cubic feet per minute (CFM). This secondary gas may be exhausted by a lip type exhaust system.

Exhaust gases may be delivered to a treatment site where the gas is treated, usually for release. In the past, variable speed fans have been used to adjust for the difference in flow rates to the treatment site. However, it is desirable to maintain a substantially constant flow rate to the treatment site and to avoid adjusting the fan speed.

U.S. Pat. No. 2,761,373 discloses a venting system for a moveable spray booth for spray painting large structures, such as a railroad locomotive. In that system a louvered central exhaust duct is provided for exhausting fumes and other undesirable gases from the application site to a treatment site.

It is an object of this invention to provide a system for delivering exhaust gas to a treatment site at a substantially constant flow rate.

When using multiple processing tanks it is desirable to transport exhaust gases from one type of tank to a first treatment site and exhaust gases from a second type of tank to a second treatment site. In other words, the treatment site and exhaust gases should be matched.

Thus, it is another object of this invention to provide an exhaust system which is useful with at least two different types of processing tanks.

Systems employing multiple tanks may use a moveable hood and stationary duct system, but it is necessary to provide a connector or connection system between the hood and a duct.

Therefore, it is further object of this invention to provide a connector for a moveable hood and a stationary duct system.

These and other objects of this invention will become apparent from the following description and appended claims.

SUMMARY OF THE INVENTION

The invention herein meets the foregoing and other objects.

There is provided a hood system mounted on an overhead crane for movement from one processing tank to another to retrieve exhaust gases from different tanks when the tank is initially opened. There are also provided at least two treatment sites for treating gases from the different tanks. The system employs a connector that connects the hood to the appropriate stationary ducting system which then conducts the gas to the treatment site. A lip exhaust system associated with each tank is appropriately connected to the ducts and external of the hood and delivers exhaust gas during normal operation.

In order to accommodate different flow rates, there is also provided a flow rate sensor and inlet dampers so as to permit the inflow of external air into the ducts, and to adjust the flow rate to the treatment site to a substantially constant value.

For example, at a flow rate equivalent to the initial surge of about 7,000 CFM, the inlet dampers may be closed and there is no incoming air. However, at the continuous operation rate of perhaps 1,000 CFM, the dampers are opened and external air is added until the flow rate is about 7,000 CFM. Using this system there is no need to vary the fan rate, but only to open or close dampers in response to a flow rate sensor, to assure a substantially constant flow rate to the treatment site. In other words, the flow rate to the treatment site is about 7,000 CFM regardless of exhaust gas source.

As described hereinafter, the connector between the hood and the duct is a flexible box-like housing, having bellows or accordion-like sides, that is secured to duct work leading to the treatment site and is engagable with a location and coupling mechanism associated with the moveable hood and its supporting crane. The connector and the hood/crane combination include a locator system whereby the connection between the connector and the hood/crane can be secured and assures gas communication.

Moreover, the connector is flexible so as to adjust and accommodate to variations in the vertical distance between the hood/crane and duct. The duct adjacent the connector also includes a vent or damper system, whereby the end of the duct adjacent the connector is closed when not in operation, but can be opened in response to connection of the connector to the hood/crane.

IN THE DRAWINGS

DESCRIPTION OF THE PREFERRED EMBODIMENTS

Figure 1:
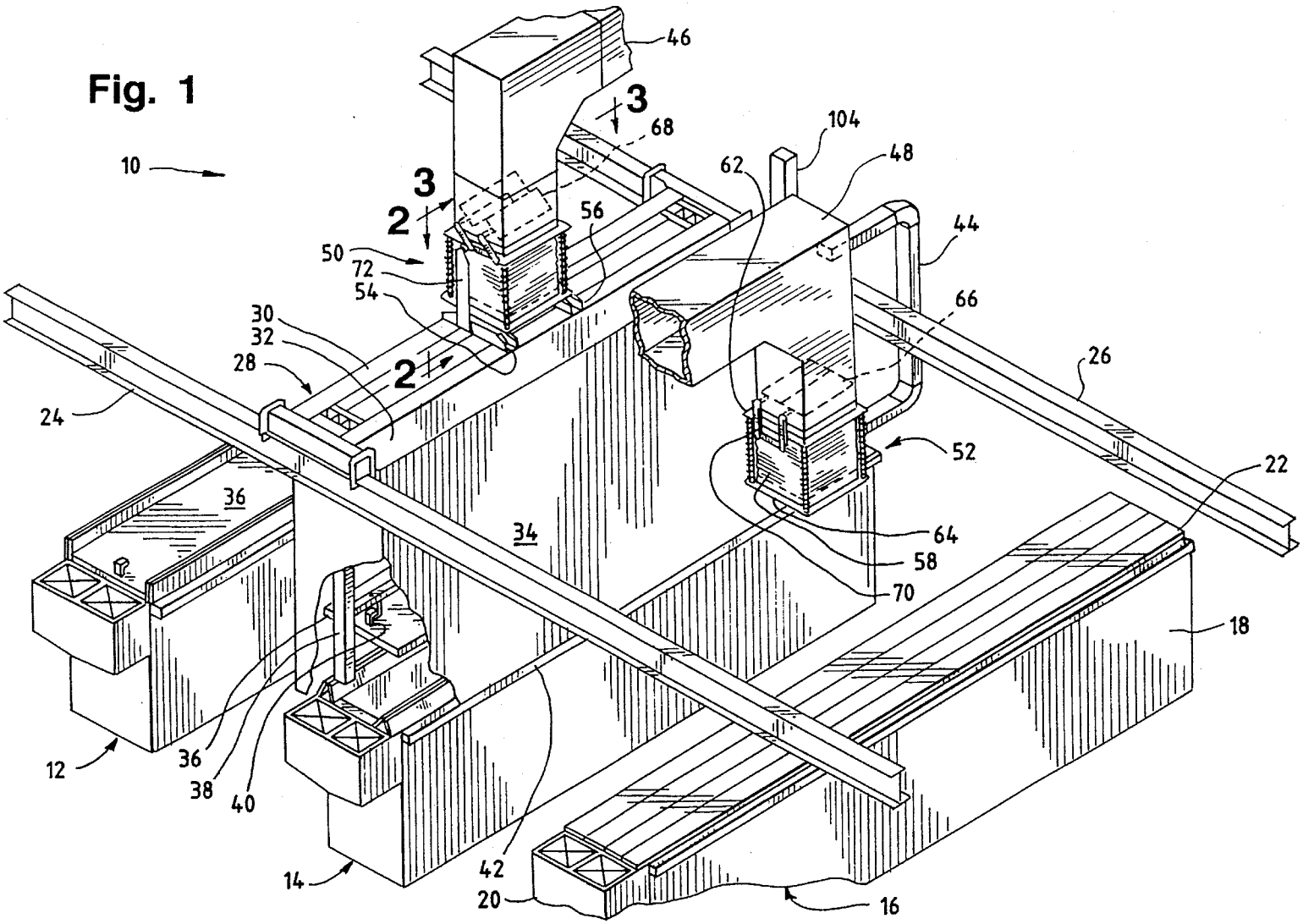
FIG. 1 is a perspective view showing three processing tanks, a hood mounted on a crane system, a pair of connectors and a pair of duct segments.

Referring first to FIG. 1, the system is shown as 10 generally. There are shown three processing tank assemblies, 12, 14 and 16 in various stages of operation. A tank assembly, such as 16 includes a body or receptacle 18, which carries the treatment solution and is to carry the work piece. The tank assembly includes a pair of overflow troughs, such as 20 and a slatted top cover 22, which is constructed to be opened by movement of the slats toward the respective sides.

An overhead crane system is suggested by the support rails 24 and 26 on which an overhead bridge 28 is journalled for controlled movement along the length of the rails and above the processing tank assemblies. The bridge includes a pair of bridge rails 30 and 32, which extend between the supporting rails 24 and 26 and to which the bridge is journalled. A hood 34 is supported by the bridge 28 and extends downwardly or is suspended therefrom. The hood is a four-sided member open at the bottom and which is about the same size as a tank assembly, so as to fit over but sealingly engage a tank assembly. The hood is closed at the top except for a gas outlet opening at its center. Exhaust fumes flow upwardly from the tank assembly into the hood for subsequent treatment and disposal.

The work piece, which is to be placed in the tank, is suspended from a removable tank lid 36, which is supported from the crane by a pair of downwardly extending adjuster arms such as 38. The arms include a latch type device 40 for engaging the lid, placing it in the appropriate position and then for removal. Referring to FIG. 1, slatted lid 22 shown in the retracted position, in connection with tank assembly 14 and work piece and lid 36 is being positioned in the downward position and the hood is being positioned above a tank assembly. There are various controls associated with the bridge, which indicate when the bridge is positioned directly above the tank.

During the initial operation, when the duct is opened, an initial surge of gas flows into the hood 34. Once the lid 36 and the associated work piece are in position, the tank assembly is closed and a continuous flow of exhaust gas is drawn from a tank assembly by a lip extract system such as 42, and to the shunt ducts such as 44 or 104. The lid 36 is fully positioned on tank assembly 12. Here that tank assembly is operating and is shown in the closed operational setting.

Each tank assembly includes various processing chemicals. For example, tank assembly 16 could be an alkali etch, tank assembly 14 a rinse and tank assembly 12 a deoxidizer. The crane bridge moves from tank assembly to tank assembly. When the tank assembly is initially opened, the hood 34 is positioned above the tank assembly and positioned to receive the initial surge of gas, which could be as much as 7,000 CFM. During operation, the lid is closed and the gas is withdrawn via the lip extract system at perhaps 1,000 CFM and is directed to a shunt duct, such as 44 or 104, which is then connected to a branch duct.

The system includes stationary branch ducts, such as 46 and 48 that are positioned above each tank and which are connected to a main duct that is directed to a treatment site. In this case, the duct 46 leads to one treatment site perhaps for alkalis and the other duct 48 goes to a second treatment site perhaps for acids.

In order to connect the ducts to the hood, a connector system such as 50 or 52 is provided. The connector system is a box-like assembly system, such as 52, which is supported by and connected to the end of each duct. In order to connect the crane/hood to a duct, a locator system is provided. The locator includes a pair of connector guide rails, such as 54 and 56, mounted to the bridge at about the center and transverse to the crane rails 30 and 32. These guide rails cooperate in connecting the crane and hood 34 to the connectors and thus the ducts 46 or 48.

The connector system includes a flexible box-like member 58, which has bellows or accordion-like sides 59 that is connected to an upper flange 62 and a lower flange 64. The ducts just above the connectors each include a damper system, such as 66 and 68. The damper systems are normally closed, the non-operative position is shown in connection with the connector 52. The dampers are opened when the hood is in position, as shown in connection with the connector 50. The dampers include downwardly weighted actuator rods or arms, such as 70, which are connected to each damper blade and are activated by the crane activator arm 72. Thus when the crane is in position, the hood is in position above the tank assembly, and the connector rails are connected, the activator arm 72 engages the arms or rods such as 70 and open the damper, so as to permit the gas in the hood 34 to enter into the duct system, such as 46.

Figure 2:
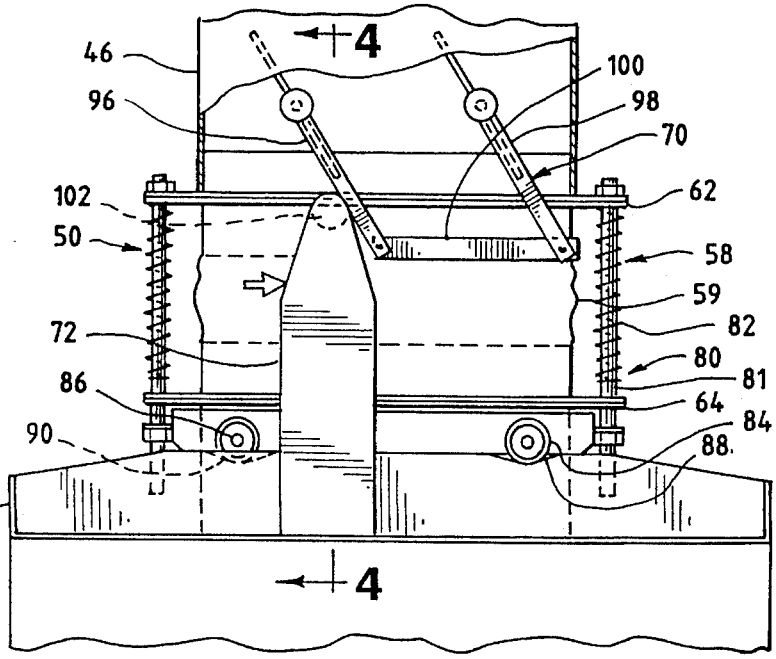
FIG. 2 is a side view of the connector system taking substantially long lines 2—2 in FIG. 1.

Referring now to FIG. 2, the guide rails, such as 54 are mounted to the crane and cooperate in connecting the crane to the connector. The activator arm 72 is shown along with the flexible member 58 land the rods 70. It is seen that the connector itself, such as 50 is secured to the end of the duct system, such as 46, by flange 62. The flexible member 58 and bellows-like sides 59 extend from the first flange downwardly to a second flange 64. The two flanges are connected and guided by a plurality of elongated bolt-like assemblies 80 at each corner of the connector. Compression springs such as 82 are positioned around about the bolt 81 and between the flanges. Thus, it is seen that the connector can move up or down depending upon the position of the guide rails. At the bottom of the connector, and on opposite sides, there are provided four carriage wheels, two of which, 84 and 86, are shown in FIG. 2, which cooperate with the rails. It is seen that the rails are slightly depressed as at 88 and 90, so that the wheels in effect find a home position and assure a positive connection between of the connector and the crane.

From FIG. 2, it can be seen that once the hood 34 is positioned, the rail, such as 54 will be positioned below the connector and the arm 72 operates to open the dampers via the pivotally connected rods 70.

Figure 3:
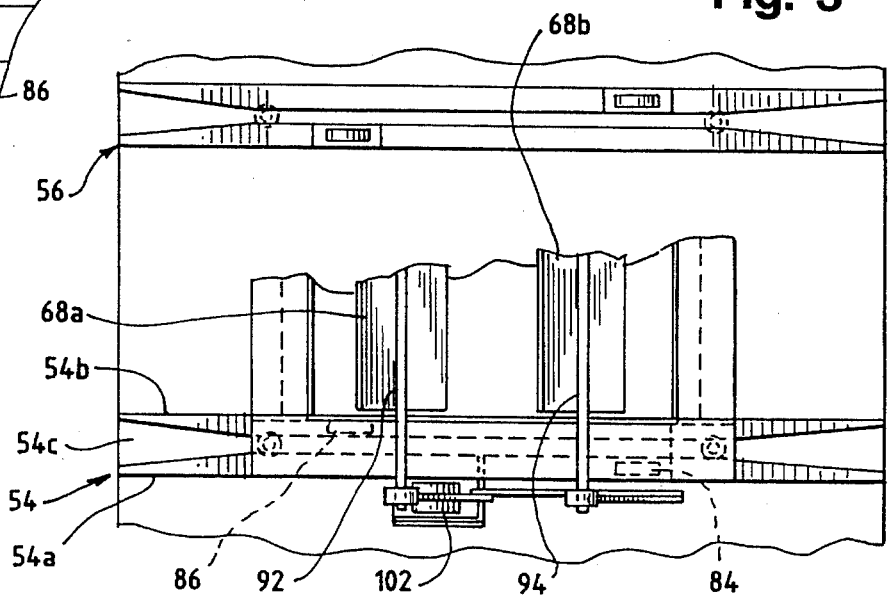
FIG. 3 is a horizontal sectional view showing the damper system and a track system for the connector and is taken substantially along line 3—3 of FIG. 1.

Referring to FIG. 3, it is seen that the guide rails 54 and 56 are each actually a pair of members, such as **54*a* and 54*b* that are closely spaced, and are flared open or have a mouth, such as 54*c* at each end. The rod ends, from the bolt-like assembly 80 extend below the lower flange 64 and below the wheels 84 and are intended to act as guides by being received by the mouth 54*c* and positioned between members 54*a* and 54*b*. This assures lateral positioning of the wheels, such as 84 and 86 on the respective members 54*a* and 54*b* and in the depressions such as 88 and 90. The wheels 84 and 86 are staggered or not in the same plane, so as to assure that they will find the correct home position. A similar set of guides, rails and wheels are provided in connection with the rail 56**.

This system assures location of the connector at the top of the bridge in order to provide the communication between the hood and the duct. It will be appreciated that the flexible connector member 58 and the springs, such as 82 are provided so as to adjust for vertical movement of the connector due to the positioning and movement of the bridge or the position of the duct.

Referring now to the damper or baffle operation, the dampers are best seen in FIG. 3 and are identified therein as **68*a* and 68*b*. Each of the dampers are pivotally mounted to the duct end, across its end and at the top of the connector and include a pivot rod, such as 92 or 94. The pivot rods connect to depending gravity operated damper weights or rods 96 and 98 that are connected by a bar 100. In the downward position, the rods 96 and 98 are positioned downwardly and the baffles are closed. When the baffle rods are moved from their downward position, the damper blades rotate to an open position. An activator arm 72 is mounted on the crane and rail system, so as to extend outwardly from the rails, such as 54, and then upwardly to an engagement point with the baffle rods 96 and 98. The activator includes a roller 102, journalled at the top of the activator arm and arranged to engage the rods, such as 96 and 98**.

Figure 4:
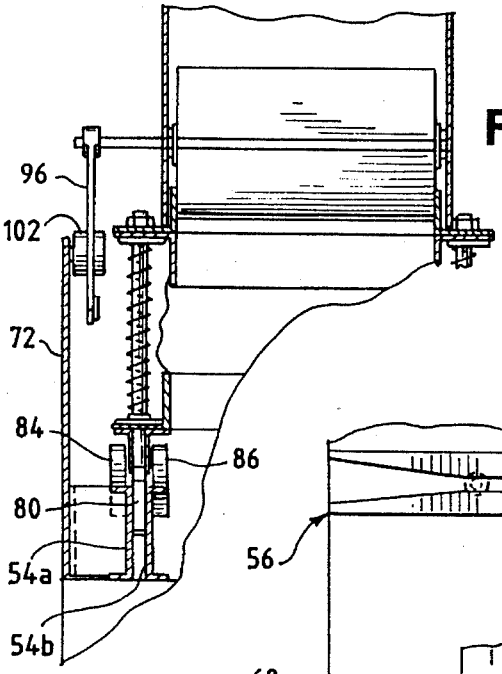
FIG. 4 is a vertical sectional view showing the connector system in section and taken along line 4—4 of FIG. 2.

Referring now to FIG. 4, the rail guide system and actuator arm can be seen. In the rail guide system, the bottom end of the assembly 80 is clearly seen as positioned between the rails 54*a* and 54*b*, the wheels 84 and 86 are shown in position at the top of the rail. The activator arm 72 is shown as mounted to the outer rail 54*a* and includes the roller 102. The roller is shown in engagement with the damper rod 96 and thus, turning the pivot rod 92 and opening the baffle 68*a* and 64*b*. Using this system, it is seen that gas from the tank 14 can pass into the hood 34 through the connector 50 and into the duct system 46. The lip extract system is connected to a shunt duct, such as 44 or 104, which is in turn connected the duct work 46 or 48 respectively, so that the same type of gases expel both through the appropriate duct 46 or 48.

Figure 5:
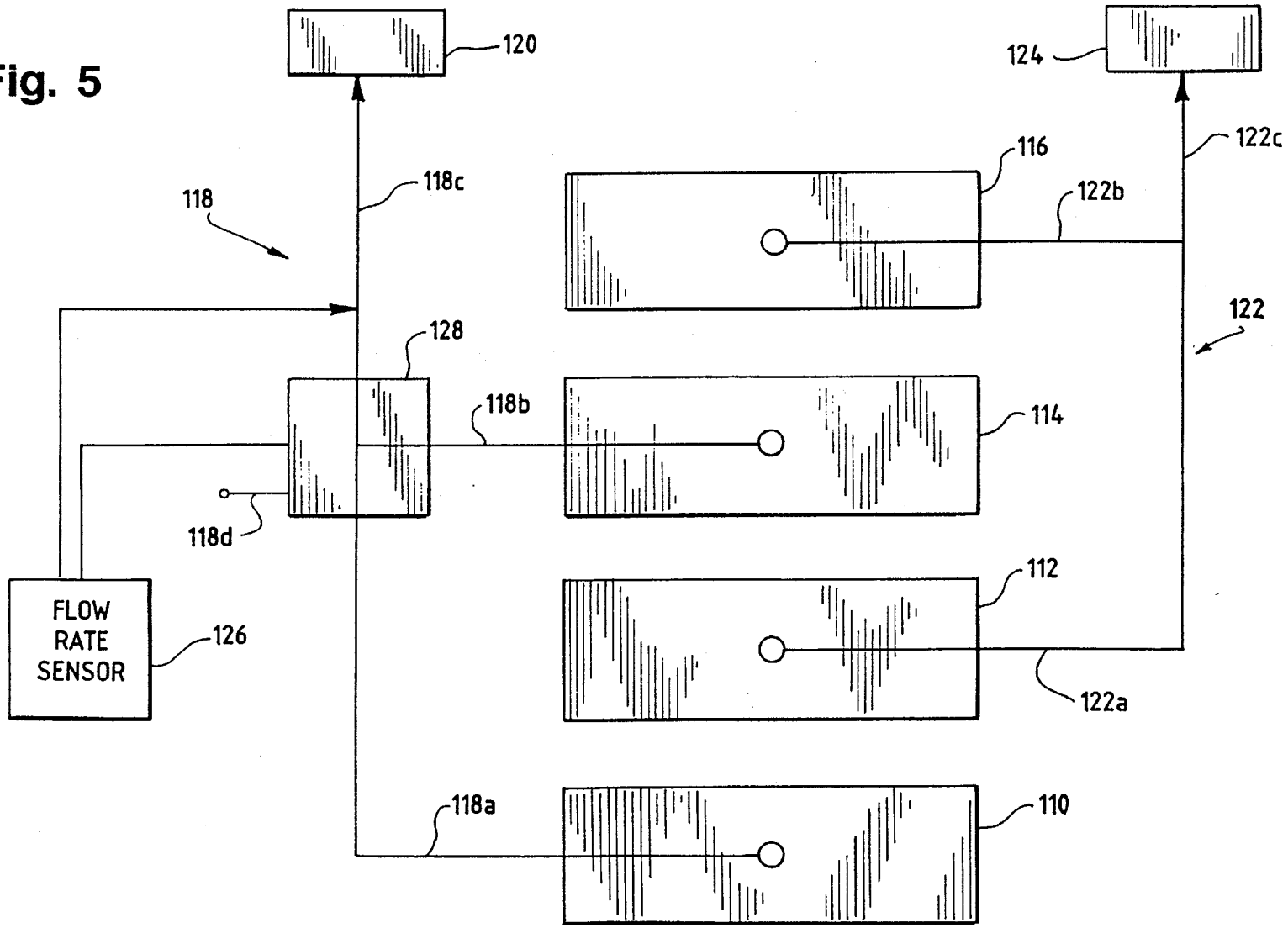
FIG. 5 is a diagrammatic view showing the flow system for the gas extracted from a processing tank and being directed toward a treatment site and for incoming fresh air.

Referring now to FIG. 5, a gas delivery system for direction to two separate treatment sites is schematically represented. The tanks 110, 112, 114 and 116 are shown. Through the mechanism described in connection with FIGS. 1 through 4, the tanks, such as 110 and 114 are connected to a duct system, such as 118 that leads to a treatment site 120. The duct system includes the branch ducts 118*a* and 118*b* and the main duct 118*c*. The tanks 112 and 116 are connected to a second duct system, such as 122 that leads to a treatment site, such as 124. The duct system includes branch duct 122*a* and 122*b* and the main duct 122*c*. One treatment site can be for alkali treatment and the other for an acid treatment.

However, because of the differences between initial flow rates and continuous flow rates, the flow rate to the treatment site can vary, but it is desirable to maintain operation of the treatment site at approximately the same flow rate. For example, the initial flow rate from a tank may be as high as 7,000 CFM. However, the continuous flow rate operating through the exhaust system may be at about 1,000 CFM. Thus, in order to maintain a constant flow rate of say 7,000 CFM, to the treatment site, it is necessary to adjust the flow rate being delivered to the treatment site. In the system as shown in FIG. 5, a flow rate sensor 126 is provided to sense the flow rate in a line, such as 118*c* upstream of the treatment site. There is also provided in the line, such as 118*c* a damper system 128 that is connected to the flow rate sensor 126.

In the normal condition, the damper system is closed. In the open position, the damper system is adjusted and permits fresh ambient air to be drawn into the duct system 118 through duct 118*d*. In the event the initial surge in 118 is sensed as 7,000 CFM, the damper system 128 is closed and the treatment site 120 operates. In the event that the flow rate in line 118*c* is at continuous operation level of 1,000 CFM, the flow rate sensor senses that and opens the damper so that an additional 6,000 CFM of air can be added to line 118*c*. This provides 7,000 CFM to the treatment site 120. In this way, the treatment site whether it's 120 or 124 continuously operates at the same flow rate regardless of the flow rate that is being discharged from the operational tanks.

This type of continuous flow rate is desirable and avoids the need to raise or lower the operation of the treatment site.

It will be appreciated that various changes and modifications can be made to the embodiment disclosed herein without departing from the spirit and scope of this invention.

We claim as our invention:

1. A connector for connecting a moveable exhaust gas hood/crane combination to a stationary exhaust duct and for the passage of gas there through, said connector comprising:

a body having a top for securement to an exhaust duct, a bottom for cooperation in connection to a hood/crane combination, and a flexible bellows-like member connecting the top and the bottom and defining the sides of the body, a plurality of guide members associated with the bottom of the body at opposite sides, for cooperation in guiding and securing the body into engagement with the hood/crane combination, a plurality of resilient members connecting the top and bottom and constructed to guide and adjust the movement of the body.

2. A connector as in claim 1 wherein the top is formed from a flange-like member, the bottom is formed from a flange-like member and said flange-like members define a box-like shape for the connector.

3. A connector as in claim 1 wherein each of said resilient members comprise an elongated bolt-like member having a compression spring coiled thereabout and positioned between the top and bottom flange, and each secured to the top and extending to the bottom.

4. A connector as in claim 1 wherein each of the guide members are rollers journalled to the bottom, and wherein there is a pair of rollers on each of the opposite sides, and each member of each pair of rollers is in a different vertical planes.

5. A connector as in claim 1 and in combination with a stationary duct wherein there is provided in association with the duct and adjacent the connector, a damper system, extending across the duct and connector to control flow and operator members associated with the damper system for maintaining the damper system in a normally closed position and for moving the damper system to an open position in response to positioning of the hood/crane combination relative to the body.

6. A connector and damper system as in claim 5 wherein the damper system includes a pair of damper blades pivotally connected to the exhaust duct and adapted to pivot about an axis between a damper open and a damper closed position.

7. A connector and damper system as in claim 6 wherein the operator members are provided and include a pair of rods, one associated with one of said damper blades.

8. A connector and damper system as in claim 7 wherein the operator members are gravity sensitive and in the blade closed position the operator member is in a downward position.

9. A connector and damper system as in claim 5 and in combination therewith there is provided an activator system mounted to the crane and for engagement with said connector, said activator system including an arm mounted to the crane and extending to a position to engage the damper operator members.

10. A connector as in claim 1 wherein at least a portion of the resilient members extend below the bottom of the connector, and in combination therewith a hood/crane combination a rail system having a pair of rails each pair having two spaced members with flared open ends, and the portion of the resilient members is constructed to fit between the spaced members and guide the connector and hood/crane into connection.

11. A structure for exhausting gases from a plurality of processing tanks and delivering gases to a treatment site at a substantially uniform flow rate; said structure comprising, a first branch duct structure for receiving exhaust gases from a first tank;

a second branch duct structure for receiving exhaust gases from a second tank;

a main duct connected to each of the branch ducts and the treatment site;

sensor apparatus associated with the main duct and positioned upstream of a treatment site and downstream of the branch ducts;

a damper member associated with the main duct for permitting ambient air to enter the main duct and associated with the sensor apparatus for opening the damper member when the sensed flow rate is below a pre-determined level and closing the damper member when the flow rate is above a pre-determined level;

so that a substantially uniform flow rate is maintained to the treatment site even if the exhaust gas flow rate is variable.

12. A process for providing a uniform flow rate to a treatment site, comprising the steps of:

providing a first tank and a second tank each of which emit an exhaust gas, duct structure for receiving emitted exhaust gas, a sensor to sense the exhaust gas flow rate in the duct structure, and a damper associated with the duct structure moveable between a closed position and an open position to admit incoming fresh air flowing into the duct structure, said damper being operatively associated with the sensor to open and close at a pre-determined value, directing exhaust gas from a first tank into duct structure;

directing exhaust gas from a second tank into duct structure;

sensing exhaust gas flow rate;

operating a damper in response to the sensed flow rate so as to open and close said damper; and delivering gas at a substantially uniform rate to a treatment site.

13. A system for capturing, directing and treating exhaust gases from processing tanks, comprising:

a plurality of separate processing tanks for treatment of large parts, each of which includes a body and an openable top lid, each of which produces a initial surge of exhaust gas when the lid is first opened, and each of which includes a system for continuously exhausting gases from said tank during operation, at a rate lower than the initial surge;

a hood for collecting exhaust gas from a processing tank when the lid is opened, and an overhead crane for carrying and supporting the hood and moving the hood from a position aligned with and overlying one tank to a position aligned with and overlying another tank, said hood and said crane forming a hood/crane combination;

a pair of duct structures each member of the pair positioned to receive an exhaust gas of a pre-determined type for delivery to a treatment site of a pre-determined type;

said hood/crane combination being moveable from one processing tank to another and constructed to receive and collect exhaust gas and direct collected gases to a duct structure;

so that different types of tanks can be evacuated to the appropriate treatment site.

14. A system for capturing, directing and treating exhaust gases from processing tanks to a related treatment site, comprising:

a plurality of separate processing tanks for treatment of large parts, each of which includes a body and openable top lid, each of which produces an initial surge of exhaust gas when the lid is first opened, and each of which includes a system for continuously exhausting gases from said tank during operation, at a rate lower than the initial surge;

a hood for collecting exhaust gas from a processing tank when the lid is opened, and an overhead crane for carrying and supporting the hood and moving the hood from a position aligned with and overlying one tank to a position aligned with and overlying another tank, said hood and said crane forming a hood/crane combination;

a pair of stationary exhaust duct structures each member of the pair positioned to receive an exhaust gas of a pre-determined type, for delivery to a treatment site of a pre-determined type;

said hood/crane combination moveable from one processing tank to another and constructed to receive and direct collected gases to a duct system;

a connector for connecting the hood/crane combination to one of the stationary exhaust ducts;

said connector comprising:

a body having a top for securement to an exhaust duct, a bottom for connection to the hood/crane combination, and a flexible bellows-like member connecting the top and the bottom and defining the sides of the body;

a plurality of guide members associated with the bottom of the body at opposite sides, for cooperation in connecting the body to the hood/crane combination;

a plurality of resilient member connecting the top and bottom and constructed to adjust the movement of body as it engages the hood/crane combination;

an exhaust gas damper system secured to a duct and extending across the duct and the connector to control flow;

damper operator members associated with the exhaust gas damper system for maintaining the damper system in a normally closed positioned and for moving the damper system to an open position in response to positioning of the hood/crane combination;

sensor apparatus associated with the duct structure, upstream of a treatment site and downstream of the tanks; and an air admission damper associated with duct structure for permitting ambient air to enter duct structure, and associated with the sensor apparatus for opening the air admission damper when the sensed flow rate is below a pre-determined level and closing the air admission damper member when the flow rate is above a pre-determined level.

* * * * *